US007752881B2

(12) United States Patent
Hofele et al.

(10) Patent No.: US 7,752,881 B2
(45) Date of Patent: Jul. 13, 2010

(54) PRESS DRIVING MODULE AND METHOD OF PROVIDING A PRESS LINE

(75) Inventors: Hans Hofele, Goeppingen (DE); Andreas Lauke, Gruibingen (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 1015 days.

(21) Appl. No.: 11/497,266

(22) Filed: Aug. 2, 2006

(65) Prior Publication Data

US 2007/0062247 A1 Mar. 22, 2007

(30) Foreign Application Priority Data

Aug. 16, 2005 (DE) ..... 10 2005 038 583

(51) Int. Cl.
*B21J 9/18* (2006.01)
*B30B 15/14* (2006.01)

(52) U.S. Cl. ..... 72/441; 72/443; 72/453.02; 72/453.03; 72/453.04; 72/450; 72/454; 72/455; 100/270

(58) Field of Classification Search ..... 72/441, 72/442, 443, 446, 453.02, 453.03, 453.04, 72/450, 454, 455, 456; 100/270, 282, 291, 100/292

See application file for complete search history.

(56) References Cited

U.S. PATENT DOCUMENTS 2,128,152 A * 8/1938 Macmillin ..... 72/453.03
3,143,007 A * 8/1964 Thompson ..... 72/453.03
4,039,111 A * 8/1977 Rogers ..... 72/441
4,045,995 A * 9/1977 Sparks ..... 72/450
4,559,807 A * 12/1985 Ganago et al. ..... 72/454
4,924,693 A * 5/1990 College et al. ..... 72/453.03
5,669,128 A * 9/1997 Futamura et al. ..... 72/442
6,041,699 A 3/2000 Seto et al.

FOREIGN PATENT DOCUMENTS

DE 41 09 796 A1 10/1992
JP 2000-343283 A 12/2000

* cited by examiner

*Primary Examiner*—David B Jones
(74) *Attorney, Agent, or Firm*—Crowell & Moring, LLP

(57) ABSTRACT

Press driving modules are provided to permit a standardized press design. The presses of a press line are equipped with always identical press driving modules, and the pressing force of the presses is varied only by the adaptation of the number of press driving modules. The press driving modules each contain two driving devices, respectively, that interact parallel or in series and have different characteristic curves. In particular, they have different maximal traveling speeds and different maximal forces. They can also have a different design with respect to their positioning capability and path resolution. This concept permits not only a standardization of presses of different performance classes within a press line but, beyond that, the largely free definition of characteristic path-time curves of the slides, and thereby finally also a freer design of workpieces, particularly of vehicle body parts.

16 Claims, 3 Drawing Sheets

PRESS DRIVING MODULE AND METHOD OF PROVIDING A PRESS LINE

This application claims the priority of DE 10 2005 038 583.4-14, filed Aug. 16, 2005, the disclosure of which is expressly incorporated by reference herein.

BACKGROUND AND SUMMARY OF THE INVENTION

The present invention relates to a press driving module and to a method of providing a press line.

In the past, the slides of large-scale presses with a mechanical drive, as a rule, were connected by way of connecting rods with an eccentric drive which, in turn, was driven by a driving motor and a flywheel at a relatively uniform speed. Because such drives to an extent result in limitations with respect to the path-time course of the slide movement, efforts were made to drive the slide, for example, by way of a servo motor, in which case the path-time curve of the slide movement could then be relatively freely adjusted by the corresponding control of the servo motor. For this purpose, DE 41 09 796 C2, for example, discloses a drive of the slide by way of a connecting rod and an eccentric which is driven by a servo motor. The servo motor can run forward and backward and can be accelerated and decelerated in a targeted manner.

The same German patent document reveals the drive of the slide by way of a toggle mechanism which, in turn, is driven by a servo motor by way of a connecting rod and an eccentric. The desired path-time courses can be adjusted within wide limits also in this configuration.

U.S. Pat. No. 6,041,699 also discloses a slide drive of a press by way of servo motors and a toggle mechanism. A screw spindle mechanism and servo motors are used for driving the toggle mechanism.

Furthermore, JP 2000 343283 shows the drive of a press slide by way of spindle stroke mechanisms that are actuated by servo motors. This also achieves a largely free fixing of the path-time course of the slide movement.

The introduced solutions each suffer from specific limitations. If, for example, non-linear mechanisms, such as toggle mechanisms or eccentrics, are used for driving the slide, the slide movement is often not as freely adjustable as desired. In addition, the entire forming force has to be applied by the servo motor. The latter is disadvantageous particularly in the case of the last-mentioned drive concepts. Although non-linear drives, such as toggle mechanisms or eccentric mechanisms, permit a higher force to be generated in the proximity of the dead center, this takes place only along a relatively short path. The drive of the press slide by way of the spindle stroke mechanism, on one hand, permits a very free fixing of the path-time course of the slide movement but limits the maximal force which can be applied before the lower dead center is reached.

An object of the present invention is to improve the randomly controllable press drive.

This object has been achieved by a press driving module, a first characteristic force-path curve, a second driving device operatively connected at least with another of the at least one first and second outputs and has a second characteristic force-path curve different from the first characteristic force-path curve, wherein the press driving module is a constructional unit. In addition, the present invention is achieved with a method of producing a press line having several presses in which the aforementioned first and second characteristic force-path curves are used and uniform driving modules are used in different numbers.

The press driving module according to the present invention is a combination of two driving devices which have different force-path curves. This is preferably achieved by utilizing different driving concepts. As a result, not only path-time courses of the slide movement which are arbitrary within wide limits can be reached, but that driving device which has the currently fitting characteristic for each part of the path-time curve can be used. For example, for rapidly passing through characteristic curve sections requiring only a low actuating force, a weak but fast drive can be used. For carrying out forming operations which, as a rule, is to be carried out without interruption but nevertheless relatively slowly but at a high force, that driving device can be used which applies a high force while the working speed is relatively low.

In the simplest case, the two driving devices, which are combined in the press driving module, can be formed, for example, by servo motors with a gearing on the output side and different gear ratios. The servo motors may have the same or a different construction. As a result of the different gear reduction, the servo motors, although they act upon the same output, operate in different characteristic curve ranges while the output speed is the same, which, on the whole, increases the design space with respect to the achievable path-time courses of the slide movement. In addition, the margin with respect to the achievable forces is increased.

The above-indicated press driving module is therefore versatile and can be used as a basis for equipping differently sized presses of a press line. On one hand, with the given press driving module, a large range of desired forces and traveling speeds can be achieved. On the other hand, unless prevented by constructive or other limits of practicality, any number of press driving modules can in principle be connected in parallel. Thus, a press slide can be driven by one or more identical press driving modules, whereby different performance classes can be provided within a press line. Furthermore, it becomes possible to provide driving modules in different performance classes, the driving modules being uniform within each performance class.

As a result of the combination of several driving modules from one or two or more performance classes and the large performance range of each press driving module, all presses of the press line can therefore be equipped with the standardized press driving modules. A press working line can therefore be constructed whose first station (drawing station) has a larger number of press driving modules, while the subsequent, as a rule, less loaded press stations are equipped with correspondingly fewer press driving modules. In the individual stations of the press line, different slide path-time courses and different slide strokes can be driven in this case.

It is particularly expedient for the performance classes of the provided press modules having a uniform maximal stroke to be exponentially graduated. As a result of the combination of press driving modules of different performance classes, many different applications can therefore be permitted. The performance classes of the driving modules are determined, for example, by the maximal forces to be applied by the driving modules. In this case, even the driving modules of different performance classes preferably have the same maximal stroke. This permits the combination of press driving modules of different performance classes with one another for forming the common drive of a slide of a press. Furthermore, the press driving modules of the different performance classes preferably have the same maximal displacement rates. Like the uniformly defined maximal stroke, this facilitates the parallel arrangement for the common drive of one and the same slide.

The press driving modules each form constructional units, which are preferably constructed separately from the press. They can therefore be prefabricated and be installed as a finished module in correspondingly prepared press frames. The press driving modules can be assembled separately from the press frame. This is important particularly in the case of large-scale presses. This concept can lead to a simplification of the production and shorten the construction time of presses.

For many purposes, it is advantageous for at least one of the driving devices of the press driving modules to contain a gearing with a variable ratio. This can, for example, be a toggle mechanism, an eccentric mechanism, and combination thereof or another gearing with a variable ratio. These are particularly gearings which supply an infinitely large power ratio or, in other words, a fixed supporting point in their dead center or reversal point, in that the force to be supported is no longer determined by the driving servo motor but only by the loading limits of the gearing. This is important, for example, in the case of solutions in which the driving devices are constructively arranged in series. For example, a servo-motor-driven eccentric drive can be connected in series with a hydraulic cylinder. While the eccentric drive then has the purpose of rapidly driving the slide in ranges of its movement curve at a relatively low force, the hydraulic driving device can have the purpose of slowly driving the slide for the workpiece forming at a high force. If, in this case, the eccentric is in the dead center position, the servo motor remains essentially free of forces. It therefore becomes possible, with relatively weak servo motors and a relatively short-stroke hydraulic device, to generate a large movement stroke for the slide, on one hand, and a high forming force, on the other hand. This advantage can also be achieved used other serially arranged driving devices.

Particularly in the case of serially arranged driving devices, it may be advantageous to activate these successively with respect to time. The two different driving devices are therefore responsible for different sections of the path-time curve of the slide movement. In the transition range from the activation of one driving device to the activation of the other driving device, both driving devices can be activated in an overlapping manner.

Particularly in the case of a parallel arrangement of the two driving devices, these are preferably activated jointly, supplementing one another with respect to developing their force.

It is advantageous for the press driving module to have a separate base frame which takes over the guidance between the two outputs. Furthermore, a housing can be provided in which the at least two driving devices are accommodated. As an alternative, however, it is also contemplated to integrate the press driving module at least partially in the press frame. For example, one of the outputs can be constructed as part of a press head piece or slide.

Preferably an energy accumulator, such as a mechanical, electric or hydraulic energy accumulator, is assigned to the press driving modules. This minimizes the supply system loading.

In principle, the press module may have many different constructions. Almost all embodiments, however, have the characteristic that the introduction of force of the at least two driving devices pertaining to the module takes place at the slide and/or at the head piece in each case at a common point. In addition, the press driving modules define a fixed numerical ratio between the number of the first driving devices and the number of the second driving devices. If a slide is driven, for example, only by driving modules of a single performance class which each, for example, have s first driving device and a second driving device, irrespective of the number of press driving modules, on the whole, just as many first driving devices as second driving devices are present for driving the slide.

If press driving modules are conceived with, for example, a first driving device and two or more for example, three second driving devices and are used for driving the slide, in the example, three times as many second driving devices are present as first driving devices. If press driving modules of different performance class and with different ratios between the numbers of the first and of the second driving devices are used, these numerical ratios in each case apply in groups to the press driving modules of the respectively considered performance class.

The driving devices of the press driving module are preferably mechanically independent of one another; that is, they can be controlled independently of one another. The synchronization of their working movement or their coordination preferably takes place electrically. The individual modules or also just their driving devices or drives can be actuated depending on the design or, as required, also switchably optionally in a path-controlled and/or force-controlled manner. They preferably permit a continuous adjustment of the slide stroke during the operation as well as a variation of the characteristic path-time curve of the slide movement during the operation. Force sensors can be provided for avoiding overloads particularly in the case of driving modules or driving devices driven in a path-controlled manner.

In addition, the individual driving devices of a press driving module can be rigidly connected with one another. As an alternative, they may be coupled with one another by coupling devices of an arbitrarily controllable type or by overrunning clutches. For example, in the case of a parallel arrangement of two driving devices, the slow driving device can be uncoupled from the fast-running driving device if a rapid traveling along a slide path is required. The slow drive is then coupled again when the fast drive has moved the slide back onto the uncoupling point and a large force is required during the slow slide movement.

In a serial arrangement of two driving devices in a press driving module, the fast driving device can be braked by a braking device when a slow working movement at a high force is to be generated. The stronger of the two driving devices is then not only supported on the first driving device but, in addition, or even exclusively, by the braking device. Thus, the above-mentioned coupling devices and braking devices can have the purpose of making the slide movement more efficient.

Other objects, advantages and novel features of the present invention will become apparent from the following detailed description of the invention when considered in conjunction with the accompanying drawings.

DETAILED DESCRIPTION OF THE DRAWINGS

Figure 1:
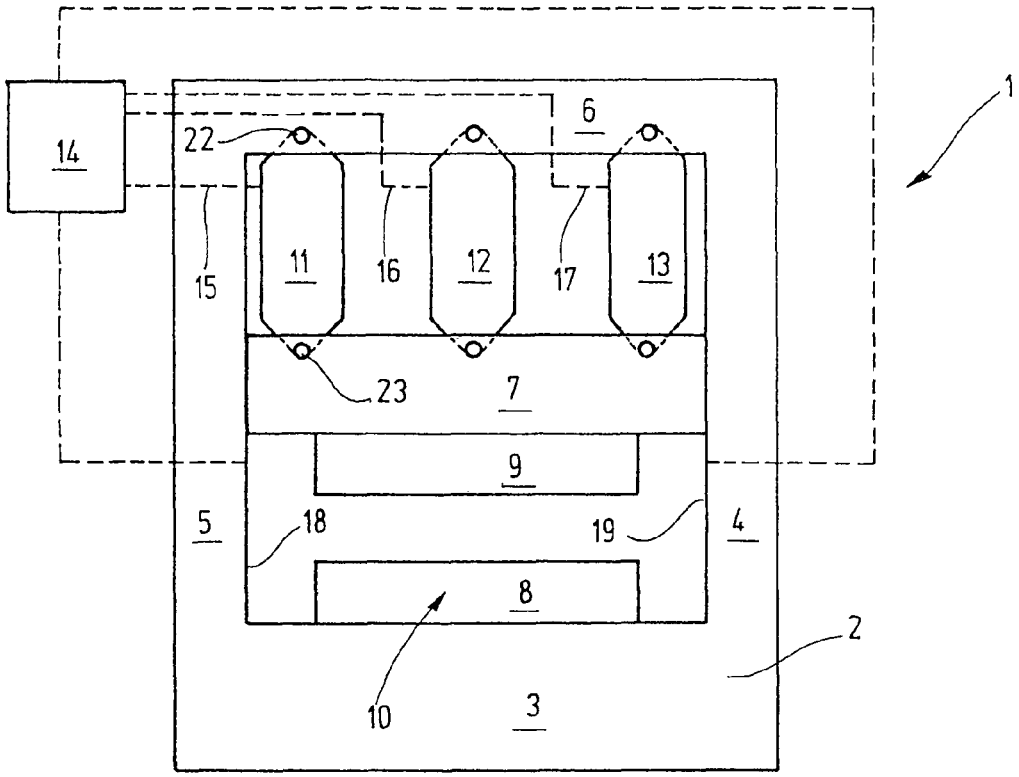
FIG. 1 is a schematic diagram of a press with a modular press drive.

Referring to FIG. 1, the press, designated generally by the numeral 1, is preferably a large-scale press, such as a vehicle body press, and can form a press station of a press working line or of a transfer press. The press 1 has a press frame 2 which comprises at least one platen 3, press supports 4, 5 and a head piece 6 connecting the supports 4, 5. A slide 7 is linearly, in the present embodiment, vertically displaceably disposed between the press supports 4, 5. A pressing die 10, which is divided into a bottom die 8 and a top die, is arranged between the slide 7 and the platen 3.

In order to be able to move the slide 7 in a targeted manner and therefore be able to open and close the pressing die 10, mutually identical, standardized press driving modules 11, 12, 13 are arranged between the slide 7 and the head piece 6. The press driving modules can generate at least a pushing or pressing force in order to move the slide 7 downward. According to the requirements, they may also be designed such that they can lift the slide 7. Particularly in the case of very large presses, whose slides 7 have a considerable weight, a counterbalancing device, for example, in the form of a pressurized pneumatic cylinder, which is not illustrated in FIG. 1, is additionally applied to the slide 7, which counterbalancing device has the purpose of counterbalancing the slide weight.

The press driving modules 11 to 13 are connected to a control device 14 which controls the operation of the press driving modules 11 to 13. For example, the press driving modules 11 to 13 can be acted upon by power, such as electric power or a pressurized fluid or both, by way of the corresponding lines 15, 16, 17, for causing the adjusting movement. As an alternative, control pulses as well as power can be transmitted by the lines 15, 16, 17, in which case the press driving modules 11 to 13 will then follow the control pulses. As required, the lines 15, 16, 17 may be configured such that information supplied by the press driving modules 11 to 13, e.g., position information, is reported back to the control device 14. In this manner, the lines 15, 16, 17 should be understood to be cables, fluid lines, bunched cables, bunched fluid lines or bunched lines that contain electric lines as well as fluid lines.

According to the desired requirements, the press 1 may be provided with one or more position sensors 18, 19 for detecting the slide position, which sensors are also connected with the control device 14.

Figure 2:
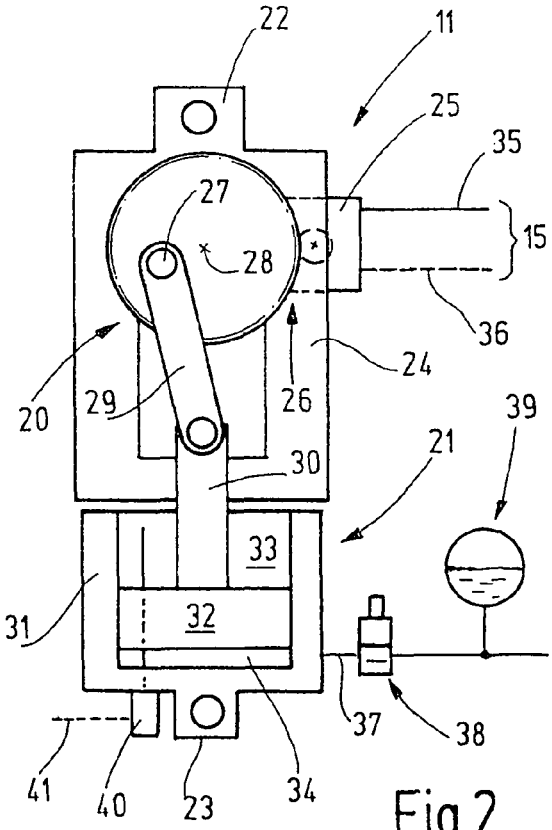
FIG. 2 is a schematic view of a press driving module for the press shown in FIG. 1.

FIG. 2 illustrates the press driving module 11 which also represents the two other press driving modules 12, 13. Additional, identically constructed press driving modules may be provided and arranged between the head piece 6 and the slide 7 in order to increase the pressing force of the press 1.

The press driving module 11 is illustrated separately in FIG. 2 in a schematic view of one exemplary embodiment. Two driving devices 20, 21 generate forces acting between outputs 22, 23 and move the outputs 22, 23 against one another. The outputs 22, 23 have, for example, the form of mechanical connection devices, such as flanges, couplings or the like and, as illustrated in FIG. 1, are in each case connected with the head piece 6 or the slide 7. In other words, the outputs 22, 23 are connection devices for the force transmission between the press driving module 11 and the head piece 6 or the slide 7 in the movement direction of the slide 7 and thus in the operative direction of the press driving module 11.

Figure 10:
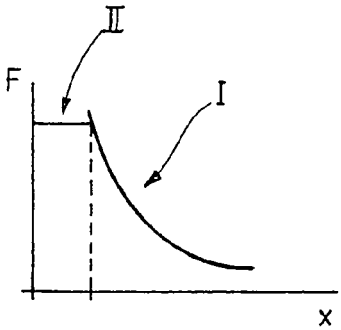
FIG. 10 is a graph of a characteristic maximal force-path curve of a press driving module.

The two driving devices 20, 21 of the press driving module 11 have different characteristic force-path curves and movement characteristics I and II, as illustrated in FIG. 10. The first driving device 20, whose characteristic curve forms the characteristic curve branch I, is constructed as a servo drive device. It has a servo motor 25 which is held on a frame 24 and, by way of a gearwheel drive 26, drives an eccentric 27 or a corresponding crank drive. The crank can be rotated around an axis 28 and is disposed in the frame 24. The frame 24 is directly connected with the output 22. By way of a connecting rod 29, the eccentric 27 drives an intermediate slide 30 which is guided in the frame 24.

The intermediate slide 30 is connected with the second driving device 21 whose characteristic curve forms the characteristic curve branch II and which is constructed in the shape of a hydraulic cylinder 31 in which a displaceably arranged piston 12 is arranged. The hydraulic cylinder 31 is directly connected with the second output 23. Two working chambers 33, 34 are bounded therein, which can be acted upon in a controlled manner by hydraulic fluid.

For controlling the driving devices 20, 21, the servo motor 25 is equipped with a control line 35 which forms a part of the line 15. In addition, it may have a position sensor which transmits position signals by way of a sensor line 36. The line 15 may also comprise a hydraulic line 37 for controlling the working chamber 34. Another hydraulic line for controlling the hydraulic chamber 35 is not illustrated but may also be present. For example, a hydraulic valve 38, a pressure source, which is not shown, as well as a pressure accumulator 39, which is only schematically illustrated in FIG. 2, are used for controlling the driving device 21.

The press driving module 11 described so far and the press 1 operate as follows. The press driving modules 11, 12, 13 are synchronously controlled by the control device 14 in order to cause an up-and-down movement of the slide 7. The path-time curve through which the slide passes 7 is similar, for example, to a sinusoid with a significantly flattened lower wave. While the upper part of this curve indicates an opening and closing of the pressing die 10 caused by low forces, the lower part of the path-time curve indicates a small stroke section above the lower dead center of the slide 7, at which the actual material forming takes place. If the stroke amounts to 500 mm, for example, the force to be transmitted to the slide 7 in the upper 400 mm, as a rule, is relatively low, while it may be higher in the lower 100 mm. As a function of the particular application, the ratios may in each case be shifted toward greater or smaller path fractions.

The press driving module 11 utilizes the driving device 20 in order to rapidly but at relatively low forces move through path sections of the overall stroke. The stroke of the intermediate slide 30 caused by the driving device 20 is less than the desired total stroke. Using the above described numerical example, by way of the first driving device 20, a movement through the upper path section of the slide path which measures 400 mm can, for example, take place. In this case, the ratio between the servo motor 25 and the intermediate slide 30 changes continuously. When approaching the upper and the lower dead center, the step-down ratio in each case moves toward infinite. This means that the ratio between the path of the intermediate slide 30 to the angle of rotation of the servo motor 25 amounts to 0 for a short time. These positions, which can also be called extension positions, represent the supporting positions of the upper driving device 20. In these positions, the upper driving device 20 can support very high forces.

When the upper driving device 20, as the slide 7 approaches its lower dead center, reaches its extension position, the second driving device 21 is activated. Hydraulic fluid will now flow into the working chamber 34 in order to carry out the last 100 mms of the working stroke. In this case, the path-time course of the slide movement can be adjusted within wide limits by influencing the mass flow rate of the inflowing hydraulic fluid. The force, which can be generated between the outputs 22, 23, here corresponds to the force of the second driving device 21. In principle, the latter may be significantly larger than the force which can otherwise be applied by the first driving device 20, for the latter is in the extension or neutral position, so that the servo motor 25 remains largely free of forces.

For controlling the position of the second driving device 21, a position sensor 40 can be provided which monitors the position of the piston 32. The position sensor 40 can be connected with the control device 14 by way of a sensor line 41 pertaining to the line 15.

As described above, the driving devices 20, 21 can be activated successively with respect to time. They can also be activated in a manner at least slightly overlapping with respect to time; that is, to start the operation of the driving device 21 when the driving device 20 approaches its lower dead center. This ensures a smooth jerk-free transition of the driving movements. In addition, the driving device 21 can have a supplementary effect when the speed of the intermediate slide 20 approaches the zero value during the approach to the lower extension position.

The introduced press driving module has the advantage that, on one hand, the operation can take place by way of relatively small servo motors and, on the other hand, only relatively small hydraulic fluid flows are required for actuating the second driving device 21.

Figure 3:
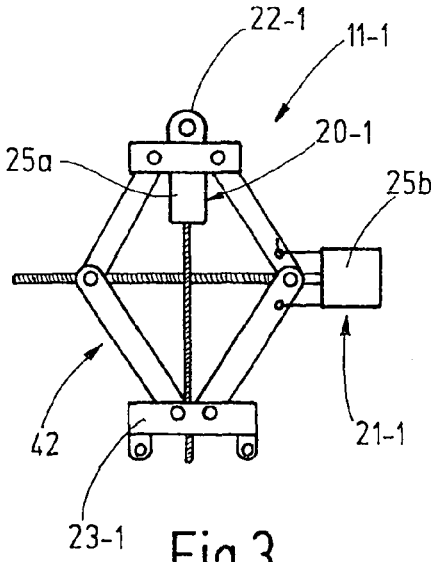
FIG. 3 is a schematic view of an alternative embodiment of a press driving module.

In the illustrated embodiment, the two driving devices 20, 21 utilize different driving concepts which are even based on different types of energy (electric power and hydraulic power). However, two driving devices 20-1, 21-1 can be combined with one another which use the same driving power, as illustrated in FIG. 3. The press driving module 11-1 illustrated there is based on two servo motors 25*a*, 25*b* which both in each case actuate a spindle stroke mechanism. The spindle stroke mechanism of the driving device 20-1 acts directly upon the lower output 23-1, while it servo motor 25*a* is connected directly with the upper output 22-1. In contrast, the servo motor 25*b* and its spindle stroke mechanism act by way of a toggle mechanism 42 which is arranged between the upper output 22-1 and the lower output 23-1. With respect to the effect, the two driving devices 20-1, 21-1 are therefore arranged in parallel. Nevertheless, the two driving devices 20-1, 21-1 supplement one another because of their different force-path characteristics. For example, driving device 20-1 increases the usable stroke to values which cannot be reached by the driving device 21-1 alone. Here, the difference between the characteristic curves is caused by the fact that driving device 20-1 acts directly and driving device 21-1 acts indirectly by way of a toggle mechanism.

Figure 4:
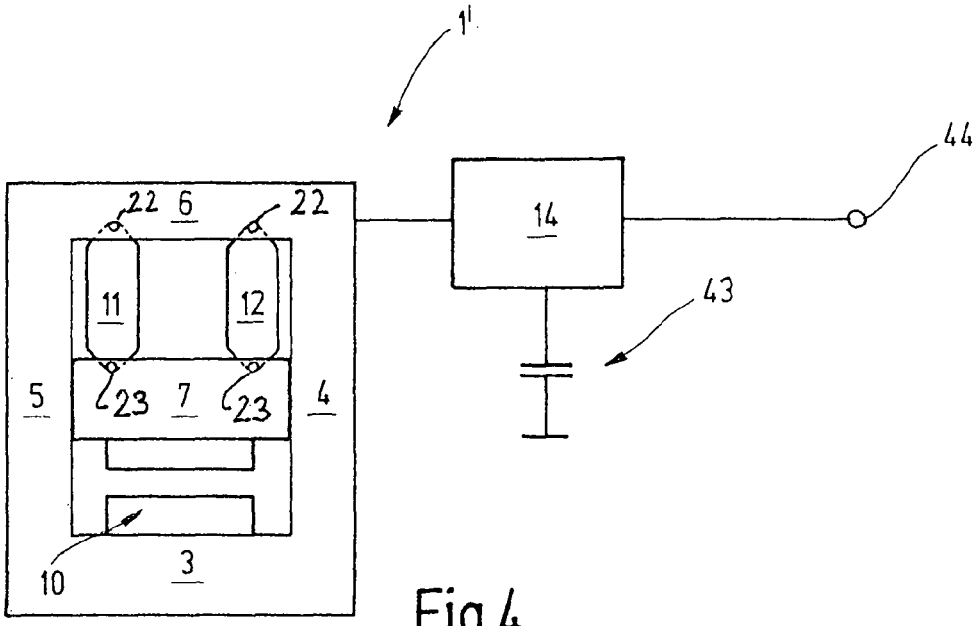
FIG. 4 is a schematic diagram of a smaller press constructed with the same press driving modules as the press as shown in FIG. 1.

As illustrated in FIG. 4, presses of different sizes can be constructed by the press driving modules 11, 12. FIG. 4 shows a press designated generally by 1' whose slide 7 is driven by only two press driving modules 11, 12. These are identical with the driving modules 11, 12 of press 1 according to FIG. 1. The above description therefore applies correspondingly. If electro-hydraulic press driving modules 11, 12 according to FIG. 2 are used, the driving devices 21 are buffered by the pressure accumulator 39, so that a corresponding uniform supply system loading results. The servo motors 25 can also be actuated from a buffer 43, for example, in the form of a motor generator set, a capacitor battery or other suitable accumulators. In addition, the control device 14 is connected to a power system 44 from which it obtains power in a relatively uniform manner, for example, for recharging the buffer 43.

Figure 5:
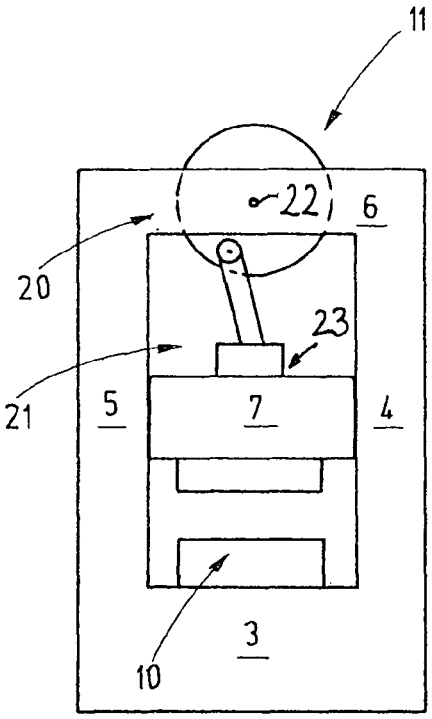
FIGS. 5 and 6 are schematic views of a press line with presses of different sizes which are equipped with the same press driving modules.
Figure 6:
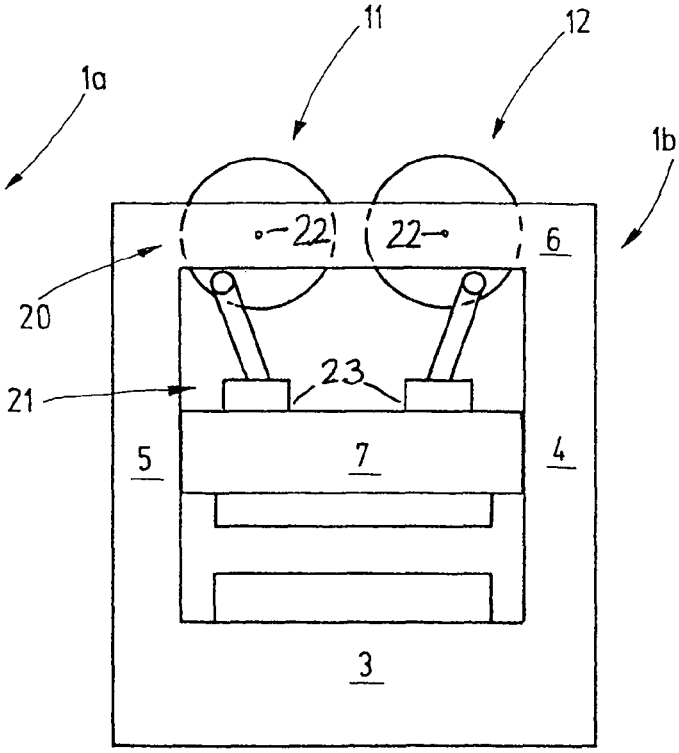

The press driving modules 11, 12 of the above-described embodiments are constructed as separate constructional units with or within their own housing and can be installed as prefabricated units in presses. FIGS. 5 and 6 illustrate a modified embodiment in which combined and standardized press driving modules 11, 12 are partially integrated in the presses 1*a*, 1*b*. Because of the general description of the presses 1*a*, 1*b*, reference is made to the above description based on the same reference numbers.

Similar to the driving module 11 according to FIG. 2, the driving modules 11, 12 of the presses 1*a*, 1*b* of FIGS. 5 and 6 pertaining to a common press line are constructed in a combined manner as a servo-motor-operated eccentric or crank drive and a hydraulic cylinder. The driving devices 20, 21, however, are not combined as a separate constructional unit but are part of the head piece 6 or of the slide 7. The above-described module concept is applied to the extent that the driving devices 20, 21 have the same mutual constructions in the case of all presses of the illustrated line. The comparatively smaller press la contains only one press driving module 11, while the press 1*b* contains two or more driving modules 11, 12, etc. Thus, the illustrated press line differs with respect to its drives only with respect to the number of used press driving modules but not with respect to their construction.

Figure 7:
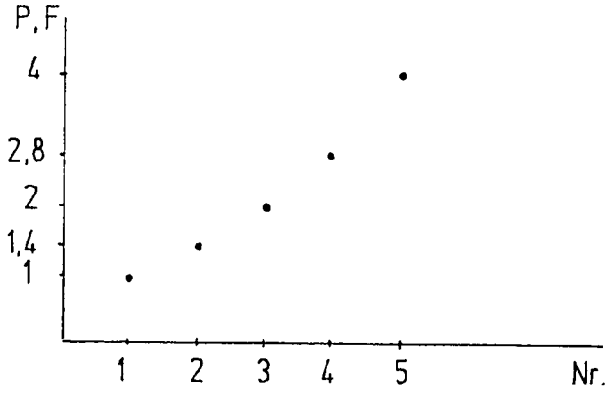
FIG. 7 is a graph of performance classes of different series of press driving modules.

As a modification of this embodiment, press driving modules of different force or performance classes or stroke classes can be provided. One example is illustrated in FIG. 7, showing five different press driving module types are illustrated there whose performances are, for example, exponentially graduated. They may differ from one another, for example, by the factor/2. By combining different press driving modules of different performance classes but of the same stroke, not only press performances within the scope of integral multiples of the performances of individual driving modules can be reached but also intermediate stages.

Figure 8:
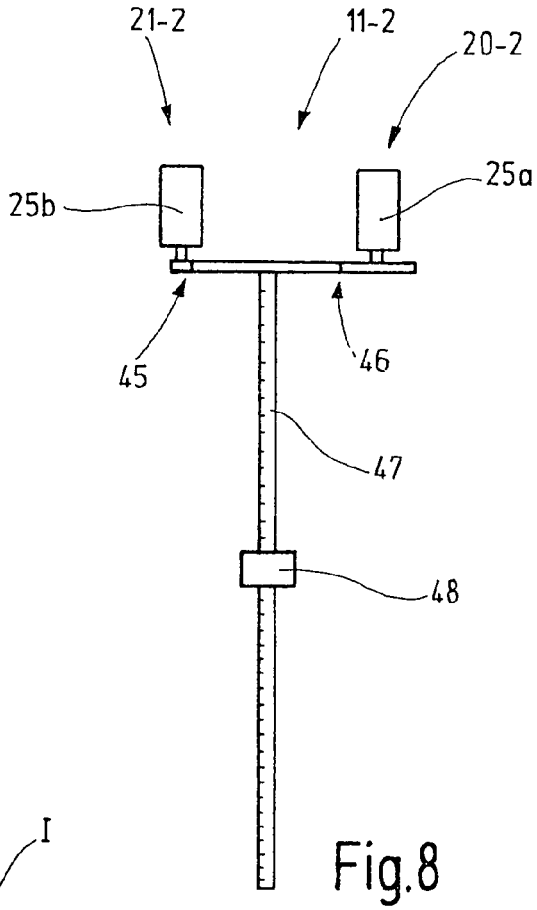
FIGS. 8 and 9 are schematic views of press driving modules of different constructions.

FIG. 8 shows a schematic additional embodiment of a press driving modules 11-2 with two driving devices 20-2, 21-2 with servo motors 25*b*, 25*c*. These act via different gear ratios by way of gearwheel drives 45, 46 upon a common threaded spindle 47 which drives a spindle nut 48 in a linearly back-and-forth manner. The servo motor 25*b* is capable of transmitting relatively high torques to the threaded spindle 47, while the servo motor 25*c* transmits lower torques but runs more slowly at a given rotational spindle speed. As a result, the servo motor 25 can generate very fast adjusting movements, while the servo motor 25*b* can generate very high pressing forces. At a rapid speed, that is, the controlling the servo motor 25*c* at full capacity, the servo motor 25*b* runs at excessive rotational speeds, at which it could not longer supply a corresponding torque itself. The application range of the servo motor drives for press slides is thereby expanded. The solution is simple and normally requires no clutches. As required, however, a switchable clutch or free wheel can be arranged between the gearwheel drive 45 and the servo motor 25*b*. Two free wheels may also be provided which operative in opposite directions and which can be blocked, if required.

Figure 9:
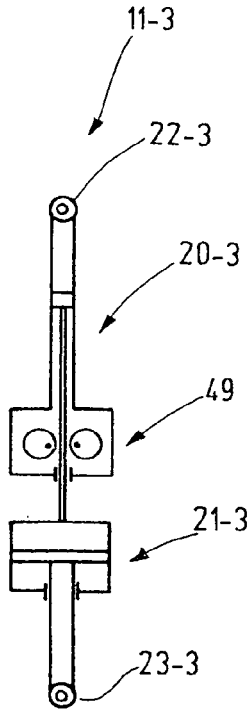

Another variant is a press driving module 11-3 illustrated in FIG. 9, and based on two hydraulic driving devices 20-3,

21-3 which are arranged in series between the two outputs 22-3, 23-3. The hydraulic driving device 20-3 is designed for long strokes at a relatively low force. The hydraulic driving devices 21-3 is designed for short strokes at a high force. Between the two driving devices 20-3, 21-3, a braking device 49 is provided to brake which the comparatively weaker driving device 20-3 can be braked. In this manner, the higher force originating from driving device 21-3 during the activation can be supported and can thus be transmitted to the output 22-3. At a rapid speed, the illustrated press driving module 11-3 thereby consumes significantly less hydraulic fluid than a correspondingly large hydraulic cylinder, and it is capable of generating the required high driving forces on a part of the movement curve of the slide.

According to the invention, press driving modules are suggested which permit a standardized construction of the presses. The presses of a press line are equipped with always the same press driving modules, the pressing force of the presses being varied only by adapting the number of the press driving modules. The press driving modules each contain two driving devices respectively which interact in parallel or serially and have different characteristic curves. In particular, they have different maximal traveling speeds and different maximal forces. They may also have a different configuration with respect to their positioning capacity and path resolution. This concept permits not only a standardization of presses of different performance classes within a press line but, beyond that, the largely free definition of path-time curves of the slides and thus finally also a freer design of workpiece, particularly of vehicle body parts.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Press driving module for a press slide of a press having a press frame for generating a driving movement and a pressing force between an at least one first output to be connected with a press frame and an at least one second output connected with the press slide, comprising:

a mechanical first driving device operatively connected with at least one of the at least one first and second outputs, wherein the mechanical first driving device has a first characteristic force-path curve, a second driving device operatively connected at least with another of the at least one first and second outputs and has a second characteristic force-path curve different from the first characteristic force-path curve, wherein the press driving module is a separate unit connectable with the press frame and press slide.

2. Press driving module according to claim 1, wherein the at least two driving devices are arranged to operate in series.

3. Press driving module according to claim 1, wherein the at least two driving devices are arranged to be activated successively with respect to time.

4. Press driving module according to claim 3, wherein the at least two driving devices are arranged to operate in series.

5. Press driving module according to claim 1, wherein the at least two driving devices are arranged to operate in parallel.

6. Press driving module according to claim 1, wherein the at two driving devices are activated simultaneously.

7. Press driving module according to claim 1, wherein the press driving module includes a base frame.

8. Press driving module according to claim 1, wherein the press driving module has a housing for accommodating the two driving devices.

9. Press driving module according to claim 1, wherein an energy accumulator is operatively associated with at least one of the at least two driving devices.

10. Press driving module according to claim 9, wherein the energy accumulator is a mechanical energy accumulator.

11. Press driving module according to claim 9, wherein the energy accumulator is a pneumatic/hydraulic energy accumulator.

12. Press driving module according to claim 9, wherein the energy accumulator is an electric energy accumulator.

13. Press driving module according to claim 1, wherein at least one of the driving devices is operatively connected through a coupling device with one of the first and second outputs.

14. Press driving module for a press slide for generating a driving movement and a pressing force between an at least one first output to be connected with a press frame and an at least one second output connected with the press slide, comprising:

a first driving device operatively connected with at least one of the at least one first and second outputs, wherein the first driving device has a first characteristic force-path curve, a second driving device operatively connected at least with another of the at least one first and second outputs and has a second characteristic force-path curve different from the first characteristic force-path curve, wherein at least one of the driving devices comprises variable ratio gearing.

15. Press driving module according to claim 14, wherein the gearing has a support position point in which an output-side movement to input-side movement ratio is zero.

16. Press driving module for a press slide for generating a driving movement and a pressing force between an at least one first output to be connected with a press frame and an at least one second output connected with the press slide, comprising:

a first driving device operatively connected with at least one of the at least one first and second outputs, wherein the first driving device has a first characteristic force-path curve, a second driving device operatively connected at least with another of the at least one first and second outputs and has a second characteristic force-path curve different from the first characteristic force-path curve, wherein at least one of the driving devices has a servo motor arranged as the drive source.

* * * * *